United States Patent [19]

Oshima et al.

[11] Patent Number: 4,567,114

[45] Date of Patent: Jan. 28, 1986

[54] THERMAL DYE-TRANSFER TYPE RECORDING SHEET

[75] Inventors: Hiroyo Oshima; Isao Kano; Yutaka Kojima; Yoshihiko Shimura; Ken Ishiguro; Koichi Nagai, all of Tokyo, Japan

[73] Assignee: Jujo Paper Co., Ltd., Tokyo, Japan

[21] Appl. No.: 484,169

[22] Filed: Apr. 12, 1983

[30] Foreign Application Priority Data

Apr. 30, 1982 [JP] Japan ..... 57-71250

[51] Int. Cl.[4] ..... B41M 5/26

[52] U.S. Cl. ..... 428/480; 8/471; 428/481; 428/500; 428/511; 428/524; 428/530; 428/913; 428/914

[58] Field of Search ..... 8/471; 428/206, 207, 428/211, 331, 537, 913, 914, 480–483, 500, 511, 524, 530, 537.5

[56] References Cited

U.S. PATENT DOCUMENTS 4,406,662 9/1983 Beran et al. ..... 8/471

4,474,859 10/1984 Oshima et al. ..... 428/481

*Primary Examiner*—Bruce H. Hess

*Attorney, Agent, or Firm*—Koda and Androlia

[57] ABSTRACT

A recording sheet for thermal dye-transfer type recording method, having a coating layer which is placed on a substrate, is contacted with a coloring material layer containing sublimable dye and on which the dye is transferred by heating. The coating layer includes as a pigment precipitated calcium carbonate of at least 25,000 $cm^2/g$ specific-surface-area and as a binder saturated polyester or a mixture of saturated polyester with polyvinyl pyrrolidone. The sheet provides a clear record with superior color density.

10 Claims, No Drawings

THERMAL DYE-TRANSFER TYPE RECORDING SHEET

BACKGROUND OF THE INVENTION

1. Field of the Invention

The present invention relates to a thermal-dye transfer type recording sheet, and more particularly to a recording sheet for thermal dye-transfer type recording method, in which a coloring material layer containing sublimable dye is provided on a base sheet, the coloring material layer is brought into contact with a recording sheet and the dye is transferred to the recording sheet by heating with a thermal head or the like.

2. Prior Art

In the thermal recording method there is widely adopted a method in which a heat-sensitive paper having thereon a recording layer to be colored under heating by a physical or chemical change is brought into contact with a thermal head and then a record of a desirable color is obtained on the heat-sensitive recording paper.

The heat-sensitive recording method, however, is defective in that coloration or contamination is readily caused in a heat-sensitive recording paper because of pressure or heat unavoidably applied to the heat-sensitive recording paper during storage or at the time of handling and that a highly resolved multichromatic recording is difficult technically.

As means for overcoming the above defects of the conventional heat-sensitive recording method there has been proposed a method as disclosed in the Japanese Patent Application Laid-Open Specification No. 15446/76. It discloses a substrate such as paper or resin film, coated with a coloring material which is solid or semi-solid at room temperatures, the coloring material coated on the substrate is brought into contact with a recording sheet and the coloring material on the substrate is selectively transferred to the recording sheet by heating by a thermal head to perform recording.

As such recording method there can be used a wet system and a dry system. The former consists of melting and softening a binder in the coloring material layer and adhereing and transfering the binder with the dye to the recording sheet, in thermal transfer recording. In the latter, sublimable dye is used in the coloring material layer, the adsorption onto the recording sheet is carried out by sublimating the dye. As the coloring material layer in the dry system, there is used a substance which is prepared by kneading a binder and sublimable dye having a sublimation temperature of 60° to 300° C.

Such sublimable dyes having a sublimation temperature of 60° to 300° C. are, for example, disperse dyes of the nitro, azo, quinoline and anthraquinone types. The transfer of the dye to the recording sheet does not occur at usual temperatures even when the coloring material layer is brought into contact with the recording sheet, but the transfer of the dye occurs first when the coloring material layer is heated to 60°–500° C. and then the dye is sublimated.

In each system, conventional plain paper can fundamentally be used. But in contrast to the wet system in which the color material layer itself is transferred, the dry system has a feature that the clearness and color density of the recorded image depend on the degree of the adsorption or fixation of sublimable dye to the recording sheet surface.

Accordingly, when the conventional plain paper is used in the dry system in which a sublimable dye having poor affinity to fiber is applied, excellent color density cannot be obtained.

SUMMARY OF THE INVENTION

The Applicant noted that in the Japanese Patent Application No. 182894/1980 the recording sheet with a coating layer consisting of a saturated polyester or a mixture of saturated polyester and polyvinyl pyrrolidone provides excellent color density.

Moreover the Applicant noted the following:

The saturated polyester of the present invention provides superior sun light fastness of the record and polyvinylpyrrolidone especially increase the color density of the record, so that polyvinylpyrrolidone in combination with saturated polyester provides excellent color density of the record not only just after the record but also after exposure to ultraviolet rays in a large quantity.

The inventors advanced the studies of the above-mentioned thermal-dye transfer type recording sheet, and we consequently found out that if precipitated calcium carbonate having large specific surface area were added to the coating color liquid, the color density of the record would much more improve. In the above-mentioned Japanese Patent Application No. 182894/1980, it was found that the addition of pigment is effective to facilitate separating the thermal transfer type recording sheet from the base sheet coated with coloring material just after thermal recording.

Still more, it has been found that precipitated calcium carbonate having a specific surface area of at least 25,000 $cm^2/g$ notably increase the color density of the record.

An object of the present invention is to provide a recording sheet having superior color density for thermal dye-transfer type recording method in which a coloring material layer containing sublimable dye is provided on a base sheet, the coloring material layer is brought into contact with the coating layer of the recording sheet and the dye is transferred to the coating layer thereof by heating.

The above object is obtained by using a coating layer of the recording sheet comprising as pigment precipitated calcium carbonate of at least 25,000 $cm^2/g$ specific-surface-area measured by a permeability method and as binder one substance selected from the group consisting of saturated polyester and a mixture of saturated polyester with polyvinyl pyrrolidone.

DETAILED DESCRIPTION OF THE INVENTION

An example of a saturated polyester which can be used in the present invention is polyethylene terephthalate (PET, melting point=260° C.) obtained by polycondensation of terephthalic acid and ethylene glycol. In addition, polybutylene terephthalate (PBT, melting point=224° C.), poly-1, 4-cyclo-hexanedimethylene terephthalate (PCHT, melting point=107° C.) can be used. Usually, these phthalic acid type polyesters are insoluble in most solvents. However, solvent-soluble or water, dispersive granular products of these polyesters have recently been developed as saturated polyester type binders. In the present invention, a solution of such saturated polyester in solvent may be used, but use of a water dispersible saturated polyester is preferred because handling of the polyester is easier.

Polyvinyl pyrrolidone is a polymer having very good water solubility and is capable of forming a transparent film; and it is known that polyvinyl pyrrolidone can be applied to manufacture medicines, cosmetics, adhesives and fiber finishing agents. The coating color for the recording sheet of the present invention includes as pigment a precipitated calcium carbonate of more than 25,000 $cm^2/g$ specific-surface-area and as binder one substance selected from the group consisting of saturated polyester and a mixture of saturated polyester with polyvinyl pyrrolidone.

It is preferred that the pigment of the present invention be added in an amount of 50 to 900 parts by weight per 100 parts by weight of the saturated polyester or the mixture of the saturated polyester with polyvinyl pyrrolidone.

As it is well know, calcium carbonate is roughly classified into two kinds, one is natural ground calcium carbonate which is manufactured by grinding limestone and the other is precipitated calcium carbonate which is manufactured by the chemical reaction between various raw materials. The calcium carbonate which is used in the present invention is precipitated calcium carbonate having a specific surface area of at least 25,000 $cm^2/g$ in case of measurement by a permeability method.

In the present invention, precipitated calcium carbonate having such particular specific surface area is used as the coating pigment; and if necessary pigment, such as precipitated calcium carbonate of under the above-mentioned specific surface area, natural ground calcium carbonate, kaolin, silica, talc, titanium dioxide, alumina trihydrate, magnesium, barium sulfate or zinc oxide etc., could be used together with precipitated calcium carbonate of the required surface area.

When the saturated polyester is used in combination with polyvinyl pyrrolidone and if the polyvinyl pyrrolidone is incorporated in an amount of 1 to 100 parts by weight per 100 parts by weight of saturated polyester, there can be obtianed a recording sheet which is most excellent in optical color density and color fastness.

The thermal transfer type recording sheet of the present invention is produced by coating the above coating color on the support such as plain paper (fine paper, etc.), coated paper, board paper, fabric, non-woven fabric and resin film, with a usual coater, such as an air knife coater or a roll coater etc., or with a size press. It is desirable to coat the coating colors at about 4–15 $g/m^2$.

The present invention will now be described in detail with reference to the following Examples that by no means limit the scope of the present invention.

EXAMPLE 1

Five coating colors were prepared by mixing 30 parts by weight (as solids) of a 40% aqueous dispersion of a saturated polyester ("Vilonal MD-1200" manufactured and supplied by Toyobo Co., Ltd.), a mixture consisting of equal amounts of a 40% aqueous dispersion of a saturated polyester and a 40% aqueous solution of polyvinyl pyrrolidone, or 5 to 20% aqueous solutions or dispersions of oxidized starch, or a styrene-butadiene copolymer latex (SBR latex) or polyvinyl alcohol independently with 70 parts by weight (as solids) of a slurry of precipitated calcium carbonate of 60,000 $cm^2/g$ specific-surface-area measured by a permeability method, (PX manufactured by Shiraishi Kogyo Kaisha).

These coating colors were coated at a coating weight of 6 to 10 $g/m^2$ onto a fine paper having Stockigt sizing degree of 12 seconds, a basis weight of 66 $g/m^2$ and a thickness of 97 $\mu m$ to obtain thermal dye-type recording sheets Nos. 1 through 5.

Separately, sublimable thermal transfer inks of blue, yellow and red were prepared by kneading 10 parts by weight of each of the following three sublimable disperse dyes; namely Disperse Blue 24 (marketed under the tradename of "Duranol Blue 2G"), Disperse Yellow 42 (marketed under the tradename of "Resolin Yellow GRL") and Disperse Red 1 (marketed under the tradename of "Celliton Scarlet B"), independently with 3 parts by weight of polyvinyl butyral and 45 parts by weight of isoprophyl alcohol by means of a three-roll mixing mill. A tissue paper having a basis weight of 30 $g/m^2$ was solidly gravure-printed with these inks to obtain a transfer substrate. The printed surface of the transfer substrate was brought into contact with the coated surface of the above-mentioned thermal dye-transfer type recording sheet and the assembly was pressed for 5 seconds to a thermal plate of 3 cm×3 cm maintained at 300° C. so that the back face of the transfer substrate was faced to the thermal plate, whereby thermal transfer to the thermal recording sheet was performed. The reflective optical densities of the blue, yellow and red recorded surface were measured by using a Macbeth densitometer. Incidentally, the reflective optical densities were measured by using a visual filter (Wratten No. 106) for the blue color, a blue filter (Wratten No. 47) for the yellow color and a green filter (Wratten No. 58) for the red color.

TABLE 1

Results Obtained in Example 1

| Thermal dye-transfer type recording sheet | | | Recorded sheet Reflective optical densities | | | |
|---|---|---|---|---|---|---|
| | Composition of coating colors | | | | | |
| No. | Pigment | Binder | Blue | Yellow | Red | Total |
| 1* | Precipitated calcium carbonate (PX) | Saturated Polyester | 1.49 | 0.80 | 1.48 | 3.77 |
| 2* | Precipitated calcium carbonate (PX) | Saturated polyester (50 wt.-parts) Polyvinyl pyrrolidone (50 wt.-parts) | 1.56 | 0.80 | 1.46 | 3.82 |
| 3** | Precipitated calcium carbonate (PX) | Oxidized starch | 0.97 | 0.55 | 1.08 | 2.60 |
| 4** | Precipitated calcium carbonate (PX) | SBR-latex | 1.00 | 0.44 | 0.94 | 2.38 |
| 5** | Precipitated calcium carbonate (PX) | Polyvinylalcohol | 1.15 | 0.42 | 0.99 | 2.56 |
| 6** | Base paper | (Fine paper) | 0.74 | 0.47 | 0.86 | 2.07 |

(NOTE)
* Present Invention
** Reference Example
High reflective optical density means good color density.

As is seen from the results shown in Table 1, even when using a precipitated calcium carbonate with a large specific-surface-area, the reflective optical densities of the thermal dye-transfer type recording shets Nos. 1 and 2 prepared by using as the binder a saturated polyester and a mixture of a saturated polyester with a polyvinyl pyrrolidone were much higher than those of the recording sheets Nos. 3 through 5 prepared by using customary paper-coating binder.

When the base paper free of the coating layer (recording sheet No. 6) was similarly tested, there was obtained only a low reflective optical density.

EXAMPLE 2

As examples of the present invention, there were prepared slurries of four kinds of precipitated calcium carbonate which have the specific surface area of at least 25,000 $cm^2/g$. (PY manufactured by Shiraishi Kogyo Kaisha, MP50 manufactured by Maruo Calcium Co. Ltd., Uniber 70 and PZ manufactured by Shiraishi Kogyo Kaisha). And as reference examples, there were prepared slurries of three kinds of precipitated calcium carbonate which have the specific surface area of less than 25,000 $cm^2/g$ (PC manufactured by Shiraishi Kogyo Kaisha, General grade and Akadama manufactured by Maruo Calcium Co. Ltd.), and three kinds of natural ground calcium carbonate (FC-40, FC-20 and Super 1500, manufactured by Maruo Calcium Co. Ltd.), kaolin talc, titanium dioxide, and barium sulfate, respectively. 85 wt.-parts (as solid content) of each slurry were added to a mixed binder liquid composed of 10 wt.-parts (as solid content) of 40% aqueous dispersion of saturated polyester (Vylonal MD-1200, manufactured by Toyobo Co. Ltd.) and 5 wt.-parts (as solid content) of 40% aqueous polyvinyl pyrrolidone solution to prepare 14 kinds of coating colors.

By coating these coating colors at 4–7 $g/m^2$ (as solid content) on the same fine paper as used in Example 1, heat transfer type recording sheets Nos. 7 through 20 were obtained. The color densities of the record which was obtained by the same thermal-dye-transfer method as used in Example 1 on each resultant sheet are shown in Table 2.

TABLE 2

Results Obtained in Example 2

Thermal dye-transfer type recording sheet

| Pigment in coating color | | | Recorded sheet Reflective optical densities | | | |
|---|---|---|---|---|---|---|
| No. | Kind | Specific surface area (Permeability method, cm/g) | Blue | Yellow | Red | Total |
| 7* | Precipitated calcium carbonate (PY) | 60000 | 1.57 | 0.88 | 1.53 | 3.98 |
| 8* | Precipitated calcium carbonate (MP 50) | 45000 | 1.54 | 0.92 | 1.44 | 3.90 |
| 9* | Precipitated calcium carbonate (Uniber 70) | 29000 | 1.43 | 0.86 | 1.46 | 3.75 |
| 10* | Precipitated calcium carbonate (P2) | 25000 | 1.41 | 0.81 | 1.38 | 3.60 |
| 11** | Precipitated calcium carbonate (PC) | 21000 | 1.13 | 0.74 | 1.28 | 3.15 |
| 12** | Precipitated calcium carbonate (General grade) | 18000 | 1.15 | 0.71 | 1.19 | 3.05 |
| 13** | Precipated calcium carbonate (Akadama) | 16000 | 1.05 | 0.72 | 1.10 | 2.87 |
| 14** | Natural ground calcium carbonate (FC-40) | 41000 | 1.17 | 0.72 | 1.21 | 3.10 |
| 15** | Natural ground calcium carbonate (FC-20) | 22000 | 1.09 | 0.71 | 1.25 | 3.05 |
| 16** | Natural ground calcium carbonate (Super 1500) | 15000 | 1.20 | 0.70 | 1.20 | 3.10 |
| 17** | Kaolin | — | 1.07 | 0.74 | 1.14 | 2.95 |
| 18** | Talc | — | 1.08 | 0.71 | 1.11 | 2.90 |
| 19** | Titanium dioxide | — | 1.07 | 0.72 | 1.14 | 2.93 |
| 20** | Barium sulfate | — | 1.07 | 0.71 | 1.12 | 2.90 |

(NOTE)
* Present Invention
** Reference Example
High reflective optical density means good color density.

According to Table 2, it is obvious that the thermal-dye-transfer recording sheets Nos. 7 through 10 of the present invention, containing the precipitated calcium carbonate which has the specific surface area of at least 25,000 $cm^2/g$ exhibit considerably higher reflective optical density, in comparison with the thermal-dye-transfer recording sheets Nos. 11 through 20 which contain the precipitated calcium carbonate having small specific surface area, various natural ground calcium carbonate, or other usual paper coating pigments.

We claim:

1. Thermal dye-transfer type recording sheet having a coating layer, the coating layer being contacted with a coloring material layer containing sublimable dye on a substrate, the coloring material being selectively transferred onto the coating layer by heating, in which the coating layer comprises as a binder saturated polyester and as a pigment a precipitated calcium carbonate of at least 25,000 $cm^2/g$ specific-surface-area measured by a permeability method.

2. Thermal dye-transfer type recording sheet having a coating layer, the coating layer being contacted with a coloring material layer containing sublimable dye on a substrate, the coloring material being selectively transferred onto the coating layer by heating, in which the coating layer comprises as a binder a mixture of saturated polyester and polyvinyl pyrrolidone and as a pigment a precipitated calcium carbonate of at least 25,000 $cm^2/g$ specific-surface-area measured by a permeability method.

3. Thermal dye-transfer type recording sheet according to claim 1 or 2, in which the saturated polyester is at least one substance selected from the group consisting of polyethylene, terephthalate, polybutylene terephthalate, poly-1, 4-cyclohexanedimethylene terephthalate and polyethyleneisophthalate.

4. Thermal dye-transfer type recording sheet according to claim 1 or 2, in which the coating layer contains at least one substance selected from the group consisting of natural ground calcium carbonate, precipitated calcium carbonate of less than 25,000 $cm^2/g$ specific-surface-area, talc, kaolin, natural silicate, synthetic silicate, amorphous silica, aluminium hydroxide, zinc oxide-and titanium dioxide, in addition to the precipitated calcium carbonate of at least 25,000 $cm^2/g$ specific-surface-area.

5. Thermal dye-transfer type recording sheet according to claim 1 or 2, in which the coating layer comprises at least one binder selected from the group consisting of modified starch, hydroxyethyl cellulose, methyl cellulose, styrene-butadiene copolymer latex, acrylic polymer latex, polyvinyl alcohol, derivatives of polyvinyl alcohol, protein, gelatine, casein, guar gum, in addition to one substance selected from the group consisting of saturated polyester and a mixture of saturated polyester and polyvinyl pyrrolidone.

6. Thermal dye-transfer type recording sheet according to claim 1 or 2, in which the base sheet is plain paper.

7. Thermal dye-transfer type recording sheet according to claim 1 or 2 in which the base sheet is a resin film.

8. Thermal dye-transfer type recording sheet according to claim 1 or 2, in which a ratio by weight of the saturated polyester to the polyvinyl pyrrolidone ranges from 100:1 to 100:100.

9. Thermal dye-transfer type recording sheet according to claim 1 or 2, in which the amount of the precipitated calcium carbonate of at least 25,000 $cm^2/g$ specific-surface-area is 50–900 parts by weight, per 100 parts by weight of the saturated polyester.

10. Thermal dye-transfer type recording sheet according to claim 2, in which the amount of the precipitated calcium carbonate is 50–900 parts by weight, per 100 parts by weight of a mixture of the saturated polyester and the polyvinyl pyrrolidone.

* * * * *